United States Patent [19]

Huxoll

[11] Patent Number: 4,657,558

[45] Date of Patent: Apr. 14, 1987

[54] METHOD FOR CONTINUOUS DYEING POLYESTER PILE FABRICS: AROMATIC NITRILE ETHER OR OXYETHYLATED CHLOROPHENOL FIXING ACCELERATOR

[75] Inventor: Dieter Huxoll, Leverkusen, Fed. Rep. of Germany

[73] Assignee: Collins & Aikman Corporation, New York, N.Y.

[21] Appl. No.: 653,941

[22] Filed: Sep. 20, 1984

[30] Foreign Application Priority Data

Apr. 16, 1984 [DE] Fed. Rep. of Germany ..... 3414306

[51] Int. Cl.[4] ..... D06P 1/62; D06P 3/54; D06P 5/20

[52] U.S. Cl. ..... 8/603; 8/532; 8/557; 8/610; 8/613; 8/616; 8/922; 8/933; 8/587

[58] Field of Search ..... 8/557, 620, 532, 603, 8/613, 616

[56] References Cited

U.S. PATENT DOCUMENTS 4,441,885 4/1984 Abel et al. ..... 8/603
4,453,946 6/1984 Abel et al. ..... 8/603

FOREIGN PATENT DOCUMENTS 52-103574 8/1977 Japan .
53-81775 7/1978 Japan .
1406803 9/1975 United Kingdom .

*Primary Examiner*—A. Lionel Clingman
*Attorney, Agent, or Firm*—Bell, Seltzer, Park & Gibson

[57] ABSTRACT

Textile fabrics formed at least partially of polyester fibers are dyed with an aqueous dyebath comprising (a) 0 to 5 g/l of thickener;
(b) disperse dyestuffs in an amount sufficient to dye the fibers to the desired depth of color;
(c) 2 to 100 g/l of a partially sulfated adduct of ethylene oxide with an alkyl phenyl or $C_8$ to $C_{16}$ fatty alcohols;
(d) 0 to 60 g/l of nonionic or anionic surfactants; and
(e) 5 to 50 g/l of at least one organic compound selected from the group consisting of aromatic nitrile ethers and ethoxylated chlorophenols.

The fabrics may be continuously dyed by padding, immersing, spraying or otherwise applying the dyestuffs, steaming the fabrics in their wet condition, and subsequently washing and drying.

16 Claims, No Drawings

METHOD FOR CONTINUOUS DYEING POLYESTER PILE FABRICS: AROMATIC NITRILE ETHER OR OXYETHYLATED CHLOROPHENOL FIXING ACCELERATOR

BACKGROUND OF THE INVENTION

This invention relates to the dyeing of textile fabrics, and in particular to a continuous process for dyeing textile fabrics formed at least partially of polyester fibers.

It is known from the technical literature (for example, W. Bernard Praxis des Bleichens und Faerbens von Textilien [Bleaching and Dyeing Practice of Textiles], Springer Verlag, 1966) and from pertinent publications that textile fabrics of polyester fibers and/or their blends with cellulosic fibers can be continuously dyed by the so-called "Thermosol Process." In applying this method, the fabric is impregnated with a cold to warm, aqueous dispersion of suitable dyestuffs and auxiliary agents to a defined weight increase, dried, subsequently "thermally fixed" at temperatures of 180° to 220° C., and again liberated from excessive dyestuff by washing. During the thermal fixation, the dyestuffs diffuse into the polyester fiber in a finely dispersed or monomolecular form, and are dissolved in the fiber. The advantage of this method is the possibility of simultaneously fixing the polyester fibers and obtaining very fast colors within a short period of time ranging from 40 to 120 seconds at 180° to 220° C.

A prerequisite for the success of the process is that the dyestuffs are already uniformly distributed in the textile product after the impregnation and intermediate drying. If not, nonuniform coloration will result. Another prerequisite is that the product is dried before the thermal fixation, since otherwise the temperatures for the Thermosol Process will not be reached because of evaporation of the dyebaths.

However, the Thermosol method has been found disadvantageous in practice, in that not all textile fabrics of polyester fibers can be dyed by this process, and that it is absolutely necessary to dry the product following the padding. In particular, it is not possible to dye pile fabrics by this method, since the dyebath migrates to the pile tips and bases during the intermediate drying, and thus, the product is dyed unevenly. Furthermore, the process is uneconomical, since the fabric needs to be dried twice during the dyeing process. Even though attempts have been made to overcome these disadvantages by the use of so-called migration inhibitors and special padding assistants, they have been unsuccessful in the case of the pile fabrics, such as, plushes, velvets and velours. A further problem with the pile fabrics, due to their high bulk and insulating characteristics, is that it is not possible to achieve Thermosol temperatures throughout the fabric in a reasonably short duration without overheating and fusing the tips of the pile yarns or leaving inner portions of the fabric insufficiently heated.

It is, therefore, an object of the present invention to develop a method for continuously dyeing polyester fibers and filaments and/or their blends with cellulosic fibers, which overcomes the aforementioned disadvantages and by which also pile fabrics can be satisfactorily dyed.

SUMMARY OF THE INVENTION

Surprisingly, it has now been found that it is possible to continuously dye textile fabrics of polyester fibers and filaments and/or their blends without having the aforementioned disadvantages, when the fabrics are impregnated in an aqueous dyebath, containing (a) 0 to 5.0 g/l of a thickener;

(b) commercially available disperse dyestuffs in an amount sufficient to dye the fibers to the desired depth of color;

(c) 2 to 100 g/l of a partially sulfated adduct of ethylene oxide with an alkyl phenol or $C_8$ to $C_{16}$ fatty alcohols, preferably nonylphenol or $C_{12}$ fatty alcohol with 1 to 6 mols ethylene oxide;

(d) 0 to 60 g/l of nonionic or anionic surfactants; and (e) 5 to 50 g/l of at least one organic compound selected from the group consisting of aromatic nitrile ethers and ethoxylated chlorophenols.

The fabric is impregnated by any suitable method, such as by padding, up to a weight increase of 60 to 250%, preferably, 80 to 160%, and is subsequently heated to a temperature and for a time sufficient to fix the dyestuffs. For example, the fabric may be steamed in the wet condition for 1 to 20 minutes in a saturated vapor atmosphere of 96°-105° C., preferably 98°-102° C., then continuously washed at 20° to 60° C. in one to six baths, mechanically drained to a residual moisture of 50 to 90%, and finally dried for 1 to 10 minutes, preferably 2 to 6 minutes, at temperatures of 140°-210° C., preferably, 170° to 200° C.

DETAILED DESCRIPTION OF THE INVENTION

The method of the present invention is characterized in that it is applicable to all fabric constructions, and that intermediate drying is not needed. Based on the special composition of the dyebath, it has thus been made possible to dye polyester fibers, which could not be dyed by steaming in a continuous process under the aforesaid conditions. Such a method has been so far unknown, and is both a considerable technical and economical advance over the prior art (Thermosol Process).

The method of the present invention is applicable to both conventional polyester (polyethyleneglycol-terephthalate) fibers and other polyesters which are known to the person skilled in the art under the term "easy dyeable" or "carrier-free dyeable" polyester fibers, as well as flame-resistant modified polyester fibers. This has so far been only possible for light shades. "Carrier-free dyeable" is here understood that no carriers, i.e., components, which are used to accelerate diffusion, are added to the dyebath. The "carrier-free dyeable polyester fibers" are modified conventional polyester fibers, which are produced by condensing polyethyleneglycols.

This method is also particularly suitable for dyeing woven blends of polyester and cellulosic fibers. Cellulosic fibers include both natural fibers, such as, for example, cotton or linen, and regenerated fibers, such as, for example, rayon or viscose, as well as esterified cellulosic fibers, such as, for example, diacetate or triacetate.

This method permits dyeing of the aforesaid fibers in their composition as textile fabrics, such as, for examples, fleeces, tricots or knits, but, in particular, woven fabrics. The textile fabrics may be both flat fabrics and, particularly, pile fabrics, such as, for example, velvet, plush or velours. The method is especially suited for dyeing polyester pile fabrics, which heretofore could not be successfully dyed in a continuous process.

Of essential importance for the invention is the composition of the dyebath. The individual operations for application of the dyebath, such as immersion, padding, spraying, scraping on, application of foam, impregnation; and the subsequent treatments, such as steaming, washing, and drying are per se conventional steps and employ known types of apparatus, as are described for example in M. Peter, "Grundlagen der Textilveredelung" [Basics of Textile Finishing], 11th edition, Deutscher Fachverlag, Frankfurt, pp. 43–47 and pp. 233–237.

According to the invention, the textile fabrics are impregnated in an aqueous dyebath by suitable application methods, such as immersion, padding, spraying, scraping on, or by the application of foam, up to a weight increase (wet pickup) of 60 to 250%, preferably 80 to 200%, and, in particular, 80 to 160%, then directly steamed in their wet condition for 1 to 20 minutes, at 96°–105° C., preferably 98°–102° C., then again washed several times at 20° to 60° C., mechanically drained and finally dried at 140° to 210° C., preferably 170° to 200° C., for 1 to 10 minutes, preferably 2 to 8 minutes, and in particular 2 to 6 minutes.

The impregnation bath is composed of:

(a) 0 to 5 g/l (preferably 0.5 to 3.0 g/l) of a thickener;

(b) up to 150 g/l (preferably 0.05 to 150 g/l and particularly 2 to 50 g/l) commercially available disperse dyestuffs;

(b') up to 100 g/l (preferably 0.05 to 50 g/l, and particularly 2 to 50 g/l) commercially available direct dyestuffs;

(c) 2 to 100 g/l (preferably 5 to 60 g/l) of a partially sulfated adduct of ethylene oxide with an alkyl phenol or $C_8$ to $C_{16}$ fatty alcohols, preferably nonylphenol or $C_{12}$ fatty alcohol with 1 to 6 mols of ethylene oxide;

(d) 0 to 60 g/l (preferably 2 to 30 g/l) nonionic or anionic surfactants, which may, for example, comprise at least one member selected from the group consisting of alkane sulfonates, alkylaryl sulfonates, sulfonated carboxylic acid esters, sulfonated carboxylic acid amides, or $C_{12}$ to $C_{25}$ fatty acids; and preferably $C_{12}$ to $C_{14}$ alkane mono-sulfonate or sodium dioctylsulfosuccinate; and (e) 5 to 50 g/l (preferably 5 to 20 g/l) of at least one organic compound selected from the group consisting of aromatic nitrile ethers or ethoxylated chlorophenols in emulsified form.

The dyestuffs under (b') may be used in addition to the disperse dyestuffs of (b) when the fabric contains cellulosic fibers or yarns in addition to the polyester fibers or yarns.

Suitable thickeners may include nonionic and/or anionic products as can be derived from the addition of ethylene oxide, from the oxidative or thermal decomposition or, respectively, carboxymethylation of guar or locust bean powder; or cellulose, starch or algin derivatives. Suitable thickeners include carboxymethylcellulose, carboxymethylstarch, alginates, such as the sodium, potassium or ammonium salts of algin. Particularly suitable are products derived from the addition of ethylene oxide as well as products with a 0.3 to 0.7 degree of substitution.

The method of the present invention may employ any of the usual commercially available disperse dyestuffs generally recognized as suitable for polyester. They may be used both as dispersed powders and aqueous dispersions. Particularly suitable are disperse dyestuffs with a relatively large molecule and of a particularly high lightfastness. The disperse dyestuffs may be used both alone and in combination with direct dyestuffs. From a chemical viewpoint, the disperse dyestuffs belong to the class of the azo or anthraquinone dyestuffs.

Likewise, the usual commercially available direct dyestuffs conventionally used for cellulosic fibers may be employed in this process. They are water soluble and can belong to the various chemical classes of dyestuffs, such as, for example, azo dyestuffs, anthraquinone dyestuffs or metallized dyestuffs. The dyestuffs particularly suitable for the method of the present invention, are selected by their solubility, high color absorption and high lightfastness. Both the disperse and direct dyestuffs may contain the usual dispersing and pulverizing assistants as well as diluent substances or salts.

Also of importance for the present method is the use of partially sulfated adducts of ethylene oxide with alkylphenols or $C_8$ to $C_{16}$ fatty alcohols, identified above as component (c). Preferred are partially sulfated adducts of nonylphenol or $C_{12}$ fatty alcohols with 1 to 6 mols ethylene oxide. Specific examples include: the ammonium salt of a partially sulfated adducts of nonylphenol with 5.5 mols ethylene oxide, the sodium salt of a partially sulfated adduct of nonylphenol with 4 mols ethylene oxide, the sodium salt of a partially sulfated adduct of a $C_{12}$ fatty alcohol with 2 mols ethylene oxide, the ammonium salt of a partially sulfated adduct of nonylphenol with 2.5 mols ethylene oxide, and the ammonium salt of a partially sulfated adduct of octylphenol with 6 mols ethylene oxide.

These products are obtained by the partial sulfation of the adducts from ethylene oxide with alkyl phenols or fatty alcohols respectively. The degree of the ethoxylation and sulfation may widely vary, and the products are obtained in the form of their ammonium or alkali, in particular sodium, salts. The component (c) acts as an emulsifier and dispersant for the dyes and can be directly added to the dyebath.

The dyebath also desirably includes anionic and nonionic surfactants, identified above as component (d). Suitable surfactants may be selected from ammonium or alkali metal salts of alkane sulfonates, sulfonated carboxylic acid esters, or sulfonated carboxylic acid amides. Preferred are $C_{12}$ to $C_{14}$ alkane monosulfonates or sodium dioctylsulfosuccinate. Specific examples include: the sodium salt of sulfosuccinic acid 2-ethylhexylester, the sodium salt of $C_{12}$ to $C_{16}$ alkanesulfonate, and the sodium salt of sulfosuccinic acid $C_{12}$ hemi-amide.

These, in general, are wetting agents which are known to the person skilled in the art under the description of rapid wetting agents. In the method of this invention, these agents serve as wetting agents during the application stage and also serve to generate foam in the steaming stage to promote level and even dyeing, especially of pile fabrics. Chemically, they are $C_{12}$ to $C_{16}$ alkane sulfonates, monoesters and diesters of sulfosuccinic acid, or monoamides or diamides of sulfosuccinic acid. The component (d) can be directly added to the dyebath. Also suitable are ammonium or alkali metal salts of alkylarylsulfonates, such as sodium dodecyl benzenesulfonate; ammonium or alkali metal salts of lauryl sulfonate, such as sodium lauryl sulfonate; ammonium or alkali metal salts of ethylene oxide adducts of lauryl sulfonate, such as the sodium salt of the addition of 1 to 6 mols of ethylene oxide to lauryl sulfonate; and ammonium or alkali metal salts of ethylene oxide adducts of $C_{12}$ to $C_{25}$ fatty acids, an example of which is the adduct of 9 to 50 mols of ethylene oxide to octadecanoic acid.

Component (e) as described above may comprise accelerators based on aromatic nitrile ethers or ethoxylated chlorophenols in emulsified form, in particular, benzyloxypropionitrile, chlorobenzyloxypropionitrile and methylbenzyloxypropionitrile, as well as di- and triethylene glycol monochlorophenyl ether. Preferably the nitrile ethers have a molecular weight of 100 to 250, in particular, 150 to 200, and that of the ethoxylated chlorophenols ranges from 150 to 400, in particular from 200 to 300.

These products are water insoluble, high-boiling liquids, which are capable of softening the polyester fibers under the conditions of the method according to the invention. Therefore, they make possible and accelerate the diffusion of the disperse dyes into the polyester fibers.

Commercially available products of component (e) are either pure substances or contain emulsifiers. Pure substances are added with the aforesaid assistants to the padding liquors in emulsified form. Particularly suitable components (e) for the present method are di- and triethyleneglycol monochlorophenyl ethers and benzyloxypropionitrile. Preferred emulsifiers for the component (e) are ethoxylated $C_{16}$ to $C_{18}$ fatty alcohols with 10 to 25 mols ethylene oxide.

The described assistants (c), (d), and (e) can be used both alone and combined with each other, and the sum of the quantities used can vary from about 2 to about 200 g/l of the dyebath.

Aside from the aforesaid ingredients, the dyebath may contain additional assistants, such as dispersing agents, wetting agents, antistatic agents and defoamers.

The following examples are intended to describe the invention in more detail, but not to limit it.

EXAMPLE 1

A raschel plush product of polyester (Trevira 220) was impregnated in a bath containing:

- 2.0 g/l modified guar powder (modified by thermal decomposition)
- 2.3 g/l Polyester Yellow LS (trade name)
- 0.59 g/l Polyester Brilliant Red BS (trade name)
- 0.3 g/l Polyester Violet 2RB (trade name)
- 1.23 g/l Polyester Blue 6102 (trade name)
- 25.0 g/l Ammonium salt of a partially sulfated adduct of nonylphenol with 5.5 mols ethylene oxide;
- 10.0 g/l Sodium salt of the sulfosuccinic acid 2-ethylhexyl ester;
- 15.0 g/l Benzyloxypropionitrile.

The material was impregnated on a padder with a 95% absorption of the bath. The product was then steamed for 10 minutes at 99° C. in a saturated vapor atmosphere, and subsequently washed five times in 30° C. water.

The material was then drained by squeezing to 75% residual moisture, and finally dried for 3 minutes on a tenter at 180° C. A grey, very uniform pile fabric was obtained with suitable lightfastness and good general fastnesses to rubbing (crocking) and washing.

EXAMPLE 2

A pile fabric consisting of (55%) polyethyleneglycolterephthalate fibers in the pile and (45%) cotton in the backing was preset for 40 seconds at 190° C. Then, the fabric was impregnated by padding with a liquor consisting of:

- 2.5 g/l locust bean powder ethoxylated with 1.5 mols ethylene oxide per OH group.
- 3.0 g/l Polyester Yellow LS (trade name)
- 12.0 g/l Polyester Yellow 7102 (trade name)
- 9.0 g/l Polyester Brilliant Red BS (trade name)
- 8.0 g/l Polyester Rubin GL (trade name)
- 5.0 g/l Polyester Blue 6102 (trade name)
- 3.64 g/l Sirus Light Orange GGL (trade name)
- 4.55 g/l Direct Bordeaux BS (trade name)
- 3.18 g/l Solamin Blue VGRL 167% (trade name)
- 40.0 g/l Sodium salt of a partially sulfated adduct of nonylphenol with 4 mols ethylene oxide
- 18.0 g/l Sodium salt of sulfosuccinic acid 2-ethylhexyl ester
- 30.0 g/l Benzyloxypropionitrile.

The absorption of the bath amounted to 98%.

The fabric was then steamed for 15 minutes at 98° C. in a saturated vapor atmosphere, then washed three times in 50° C. water, mechanically drained to 75% residual moisture, and dried for 2.5 minutes on a tenter at 190° C. The result was a dark red, uniformly dyed pile fabric with good fastnesses and a lightfastness of 7. The lightfastness was determined in all examples according to both the Opel Standards GME 60292 of 11/77 and by the FAKRA test.

EXAMPLE 3

A woven velour of 55% polyester, 35% cotton and 10% rayon was impregnated by applying foam from a bath with the following ingredients (80% absorption of the bath):

- 3.5 g/l water soluble guar derivative (1.0 mol ethylene oxide per OH group)
- 1.0 g/l Polyester Yellow LS (trade name)
- 3.5 g/l Polyester Yellow 7102 (trade name)
- 1.3 g/l Polyester Brilliant Red BS (trade name)
- 1.05 g/l Polyester Blue BGL (trade name)
- 2.5 g/l Superlightfast Yellow EFC (trade name)
- 1.5 g/l Sirius Red F3B 200% (trade name)
- 1.25 g/l Sirius Light Grey CGLL 167% (trade name)
- 20.0 g/l Sodium salt of a partially sulfated adduct of a $C_{12}$ fatty alcohol with 2 mols ethylene oxide
- 5.0 g/l Sodium salt of a $C_{12}$ to $C_{16}$ alkane sulfonate
- 15.0 g/l3-chlorophenol triethyleneglycol ether.

Following its impregnation, the material was steamed for 8 minutes in a saturated vapor at 100° C., washed four times in 50° C. water, mechanically drained to 80% residual moisture and dried for 2 minutes at 200° C. The result was a light brown, completely uniformly dyed product with excellent fastnesses.

EXAMPLE 4

A plush fabric with polyester pile and a cotton and triacetate blend in the backing was impregnated in the following bath:

- 1.5 g/l Anionically modified guar powder (degree of carboxylation 0.53)
- 4.25 g/l Polyester Yellow 7102 (trade name)
- 4.02 g/l Polyester Brilliant Red BS (trade name)
- 10.1 g/l Polyester Blue 6102 (trade name)
- 2.6 g/l Solamin Blue VGRL 167% (trade name)
- 1.8 g/l Sirius Light Blue BRR 182% (trade name)
- 0.49 g/l Sirius Light Orange GGL (trade name)
- 0.77 g/l Sirius Light Brown R (trade name)

60.0 g/l $NH_4$ salt of a partially sulfated adduct of nonylphenol with 2.5 mols ethylene oxide
20.0 g/l Sodium salt of sulfosuccinic acid $C_{12}$ hemiamide
30.0 g/l emulsifier-containing methylbenzyloxypropionitrile.

Impregnation was done on a two-roller padder with 100% absorption of the bath. Then the material was steamed in its wet condition for 14 minutes in a 98° C. saturated vapor atmosphere, subsequently continuously washed in 5 baths at 45° C., and drained by squeezing to 65% residual moisture, and finally dried for 4 minutes on a 6-section tenter at 185° C. The result was a medium to dark blue, uniform coloration with a lightfastness of 7 and very good general fastnesses.

EXAMPLE 5

A liquor consisting of
4.5 g/l carboxylated guar derivative (degree of carboxylation 0.40)
1.0 g/l Polyester Yellow LS (trade name)
3.5 g/l Polyester Yellow 7102 (trade name)
1.3 g/l Polyester Brilliant Red BS (trade name)
1.05 g/l Polyester Blue BGL (trade name)
2.5 g/l Superlightfast Yellow EFC (trade name)
1.5 g/l Sirius Red F3B 200% (trade name)
1.25 g/l Sirius Light Grey CGLL 167% (trade name)
35.0 g/l $NH_4$ salt of a partially sulfated adduct of octylphenol with 6 mols ethylene oxide
10.0 g/l Chlorobenzyloxypropionitrile was scraped with a 200% absorption of the bath on a tricot of 70% carrier-free dyeable polyester, 20% cotton, and 10% rayon, which was then steamed for 15 minutes at 98° C. It was then washed three times at 45° C. and drained to 80% residual moisture, and finally dried for 8 minutes at 160° C. The result was a blue grey, uniform coloration with excellent fastnesses. The lightfastness according to the so-called "Opel Test" ranged from 6 to 7.

EXAMPLE 6

A tricot product of 100 percent polyester was preset for 45 seconds at 180° C. Then the fabric was impregnated by padding with a liquor consisting of:
2 g/l Locust bean powder
15 g/l Polyester Brilliant Red BS (trade name)
4 g/l Polyester Rubin GL (trade name)
2.3 g/l Polyester Blue 6102 (trade name)
50 g/l Sodium salt of a partially sulfated adduct of nonylphenol with 4 mols ethylene oxide
25 g/l Sodium salt of sulfosuccinic acid 2-ethylhexyl ester
25 g/l Benzyloxypropionitrile The absorption of the bath amounts to 86%. The fabric was steamed for 9 minutes at 99° C. in a saturated vapor atmosphere and then washed three times in 50° C. water, mechanically drained to 80% residual moisture, and dried for 2 minutes on a tenter at 180° C. The result was a dark red, uniformly dyed fabric with good fastness.

That which is claimed:

1. A method of dyeing textile fabrics formed at least partially of polyester fibers comprising
(1) impregnating the fabric in a dyestuffs applicator with an aqueous dyebath which comprises:
(a) 0.5 to 5 g/l of a thickener;
(b) disperse dyestuffs in an amount sufficient to dye the fibers to the desired depth of color;
(c) 2 to 100 g/l of a partially sulfated adduct of ethylene oxide with an alkyl phenol or $C_8$ to $C_{16}$ fatty alcohols;
(d) 2 to 60 g/l of nonionic or anionic surfactants; and
(e) 5 to 50 g/l of at least one organic compound selected from the group consisting of aromatic nitrile ethers and ethoxylated chlorophenols;
(2) transferring the fabric from the dyestuff applicator to a heater and heating the wet, impregnated fabric for a time and at a temperature sufficient to fix the dyestuffs on the fabric; and
(3) washing and drying the thus dyed fabric.

2. A method according to claim 1 wherein the fabrics are impregnated with said aqueous dyebath to a wet pick-up of 60 to 250 percent.

3. A method according to claim 1 wherein the heating of the impregnated fabric to fix the dyestuffs comprises steaming for 1 to 20 minutes at 96° to 105° C.

4. A method according to claim 1 wherein the drying of the fabric is carried out at 140° to 210° C. for 1 to 10 minutes.

5. A method according to claim 1 wherein the textile fabrics comprise blends of polyester fibers with cellulosic fibers, and wherein said aqueous dyebath also includes direct dyestuffs.

6. A method according to claim 1 wherein the textile fabrics comprise pile fabrics.

7. A method according to claim 1 wherein said aqueous dyebath additionally includes auxiliary agents selected from the group consisting of dispersing agents, wetting agents, antistatic agents an defoamers.

8. A method of continuously dyeing textile fabrics formed at least partially of polyester fibers comprising
(1) advancing the fabric through a continuous dyeing range and through a dyestuffs applicator and impregnating the fabric with an aqueous dyebath comprising
(a) 0.5 to 5 g/l of a thickener
(b) disperse dyestuffs in an amount sufficient to dye the fibers to the desired depth of shade
(c) 2 to 100 g/l of a partially sulfated adduct of ethylene oxide with an alkyl phenol or $C_8$ to $C_{16}$ fatty alcohols
(d) 2 to 60 g/l of nonionic or anionic surfactants, and
(e) 5 to 50 g/l of at least one organic compound selected from the group consisting of aromatic nitrile ethers and ethoxylated chlorophenols;
(2) continuously directing the fabric from the dyestuffs applicator to and through a heating chamber and heating the fabric to a temperature and for a time sufficient to fix the dyestuffs, and
(3) washing and drying the thus dyed fabric.

9. A method according to claim 1 or 8 wherein said organic compound (e) comprises an aromatic nitrile ether of molecular weight 100 to 250.

10. A method according to claim 1 or 8 wherein said compound (d) comprises a $C_{12}$ to $C_{16}$ alkane sulfonate.

11. A method according to claim 1 or 8 wherein said compound (c) is a partially sulfated adduct of nonyl phenol with 1 to 6 mols of ethylene oxide.

12. A method according to claim 1 or 8 wherein said compound (c) is a partially sulfated adduct of $C_{12}$ fatty alcohols with 1 to 6 mols of ethylene oxide.

13. Dyed textile fabrics produced by the process of claims 1 or 8.

14. Dyed 100 percent polyester pile fabrics produced by the process of claims 1 or 8.

15. Dyed polyester fiber/cellulosic fiber blend fabrics produced by the process of claim 5.

16. A method of dyeing textile fabrics formed at least partially of polyester fibers comprising (1) impregnating the fabric in a dyestuffs applicator with an aqueous dyebath comprising (a) 0.5 to 5 g/l of a thickener;

(b) disperse dyestuffs in an amount sufficient to dye the fibers to the desired depth of shade;

(c) 2 to 100 g/l of a partially sulfated adduct of ethylene oxide with an alkyl phenol or $C_8$ to $C_{16}$ fatty alcohols;

(d) 2 to 60 g/l of nonionic or anionic surfactants; and (e) 5 to 50 g/l of at least one organic compound selected from the group consisting of benzyloxypropionitrile, chlorobenzyloxypropionitrile, methylbenzyloxypropionitrile, diethylene glycol monochlorophenyl ether, and triethylene glycol monochlorophenyl ether;

(2) transferring the fabric from the dyestuff applicator to a steamer and steaming the wet, impregnated fabric for 1 to 20 minutes at 96°–105° C. to fix the dyestuffs on the fabric; and (3) washing and drying the thus dyed pile fabric.

* * * * *